US010941616B2

(12) United States Patent
Woodward

(10) Patent No.: US 10,941,616 B2
(45) Date of Patent: Mar. 9, 2021

(54) STEP STOOL WITH RIB, AND METHOD

(71) Applicant: Stephen Woodward, Meadville, PA (US)

(72) Inventor: Stephen Woodward, Meadville, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/667,356

(22) Filed: Aug. 2, 2017

(65) Prior Publication Data

US 2018/0363374 A1 Dec. 20, 2018

Related U.S. Application Data

(60) Provisional application No. 62/521,827, filed on Jun. 19, 2017.

(51) Int. Cl.

| | |
|---|---|
| ***E06C 1/387*** | (2006.01) |
| ***E06C 1/393*** | (2006.01) |
| ***A47C 12/00*** | (2006.01) |
| *E06C 7/00* | (2006.01) |

(52) U.S. Cl.

CPC ..... *E06C 1/393* (2013.01); *A47C 12/00* (2013.01); *E06C 1/387* (2013.01); *E06C 7/00* (2013.01)

(58) Field of Classification Search

CPC ..... A47C 12/00; E06C 1/393; E06C 1/387; E06C 7/50; E06C 7/082; E06C 7/084

See application file for complete search history.

(56) References Cited

U.S. PATENT DOCUMENTS

| | | | | | |
|---|---|---|---|---|---|
| 159,627 | A * | 2/1875 | Argerbright | E06C 1/393 | 182/165 |
| 1,806,502 | A * | 5/1931 | Rosenberg | E06C 1/387 | 182/161 |
| 1,992,391 | A * | 2/1935 | Pease | E06C 1/393 | 182/125 |
| 2,703,196 | A * | 3/1955 | Hansen | E06C 1/387 | 182/123 |
| 2,952,301 | A * | 9/1960 | Schlaak | A47C 12/02 | 182/106 |
| 4,440,264 | A * | 4/1984 | Knoke | A47C 12/02 | 182/126 |
| 4,485,892 | A * | 12/1984 | Maloney | E06C 1/393 | 182/161 |
| 4,723,631 | A * | 2/1988 | Tremblay | E06C 1/387 | 182/106 |

(Continued)

*Primary Examiner* — Colleen M Chavchavadze
(74) *Attorney, Agent, or Firm* — Ansel M. Schwartz

(57) ABSTRACT

A step stool having a platform having a length at least 1.5 times a length of a first step. The platform rotatably attached to a first front leg and a second front leg above the first step. The first step having a perimeter having a first side which extends down from a top of the first step. The first step having a first boss that extends outward from the first side through which a first fastener extends to attach the first front leg to the first step. The first step having a rib which extends outwards from the first side adjacent the first boss and in alignment with the first front leg when the first and second front legs and first and second rear legs are in an open position where they form a generally upside down V shape. The rib providing support to the first front leg when a cantilever type force is applied to the stepladder. A method for using a step stool.

5 Claims, 6 Drawing Sheets

(56) References Cited

U.S. PATENT DOCUMENTS

| | | | | | |
|---|---|---|---|---|---|
| 5,722,507 | A * | 3/1998 | Kain | E06C 1/393 | 182/104 |
| 6,039,149 | A * | 3/2000 | Bedja | B62B 1/12 | 182/165 |
| 6,427,805 | B1 * | 8/2002 | Gibson | E06C 1/387 | 182/165 |
| 7,383,920 | B2 * | 6/2008 | Meeker | E06C 1/387 | 182/106 |
| 7,487,859 | B2 * | 2/2009 | Wang | B62B 1/12 | 182/20 |
| 7,984,790 | B2 * | 7/2011 | Meyers | A47C 12/00 | 182/129 |
| 8,684,139 | B2 * | 4/2014 | Leng | A47C 12/00 | 182/129 |
| 9,422,767 | B2 * | 8/2016 | Russell | E06C 1/18 | |
| 10,077,601 | B2 * | 9/2018 | Leng | E06C 7/082 | |
| 10,167,668 | B1 * | 1/2019 | Wang | B25H 1/04 | |
| 2009/0020360 | A1 * | 1/2009 | May | B60R 3/02 | 182/1 |
| 2011/0284325 | A1 * | 11/2011 | Chung | B62B 1/12 | 182/129 |
| 2014/0262617 | A1 * | 9/2014 | Mulller | E06C 1/393 | 182/107 |
| 2018/0148977 | A1 * | 5/2018 | Leng | E06C 1/387 | |

* cited by examiner

STEP STOOL WITH RIB, AND METHOD

CROSS-REFERENCE TO RELATED APPLICATIONS

This is a nonprovisional of U.S. provisional patent application Ser. No. 62/521,827 filed Jun. 19, 2017, incorporated by reference herein. This application incorporates by reference U.S. design patent application Ser. No. 29/608,055 filed Jun. 19, 2017.

FIELD OF THE INVENTION

The present invention is related to a step stool with a platform that has a rib extending from the platform to support a leg of the step stool against a cantilever type load. (As used herein, references to the "present invention" or "invention" relate to exemplary embodiments and not necessarily to every embodiment encompassed by the appended claims.) More specifically, the present invention is related to a step stool with a platform that has a rib extending from the platform to support a leg of the step stool against a cantilever type load, where the rib extends from a boss on the outside of the platform in lines with a leg which the rib is supporting.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Step stools are commonly used to access somewhat higher locations relatively often. Since they are used often, it is desirable for them to be as lightweight and a strong as possible. Typically step stools have one or two steps with a platform. The platform allows the user more freedom to securely move around while standing on the platform in accessing a desired higher location, with the step or steps providing access to the platform. It is important for safety reasons of the user to make a step stool as resistant as reasonably possible to various types of loads on the legs of the step stool so the legs do not bend or fail.

BRIEF SUMMARY OF THE INVENTION

The present invention pertains to a step stool. The step stool comprises a first front leg. The step stool comprises a second front leg in parallel and spaced relation with the first front leg. The step stool comprises a first step having a length rotatably attached to the first front leg and the second front leg, a top and a perimeter about the top. The perimeter having a first side which extends down from the top. The first step having a first boss that extends outward from the first side through which a first fastener extends to attach the first front leg to the platform. The first step having a rib which extends outwards from the first side adjacent the first boss and in alignment with the first front leg when the first and second front legs and first and second rear legs are in an open position where they form a generally upside down V shape. The rib providing support to the first front leg when a cantilever type force is applied to the step stool. The step stool comprises a first rear leg hingedly attached to the first front leg. The step stool comprises a second rear leg hingedly attached to the second front leg and in spaced relation with the first rear leg. The step stool comprises a platform having a length at least 1.5 times the length of the first step. The platform rotatably attached to the first front leg and the second front leg above the first step.

The present invention pertains to a method for using a step stool. The method comprises the steps of placing the step stool in a position so a user can climb on the step stool. There is the step of applying a cantilever load to the step stool while in the open position causing a first right leg to press against a rib which extends outwardly from a first side of a first step adjacent a first boss of the first side and in alignment with a first front leg of the step stool when the first and second front legs and first and second rear legs of the step stool are in an open position where they form a generally upside down V shape.

DETAILED DESCRIPTION OF THE INVENTION

Figure 1:
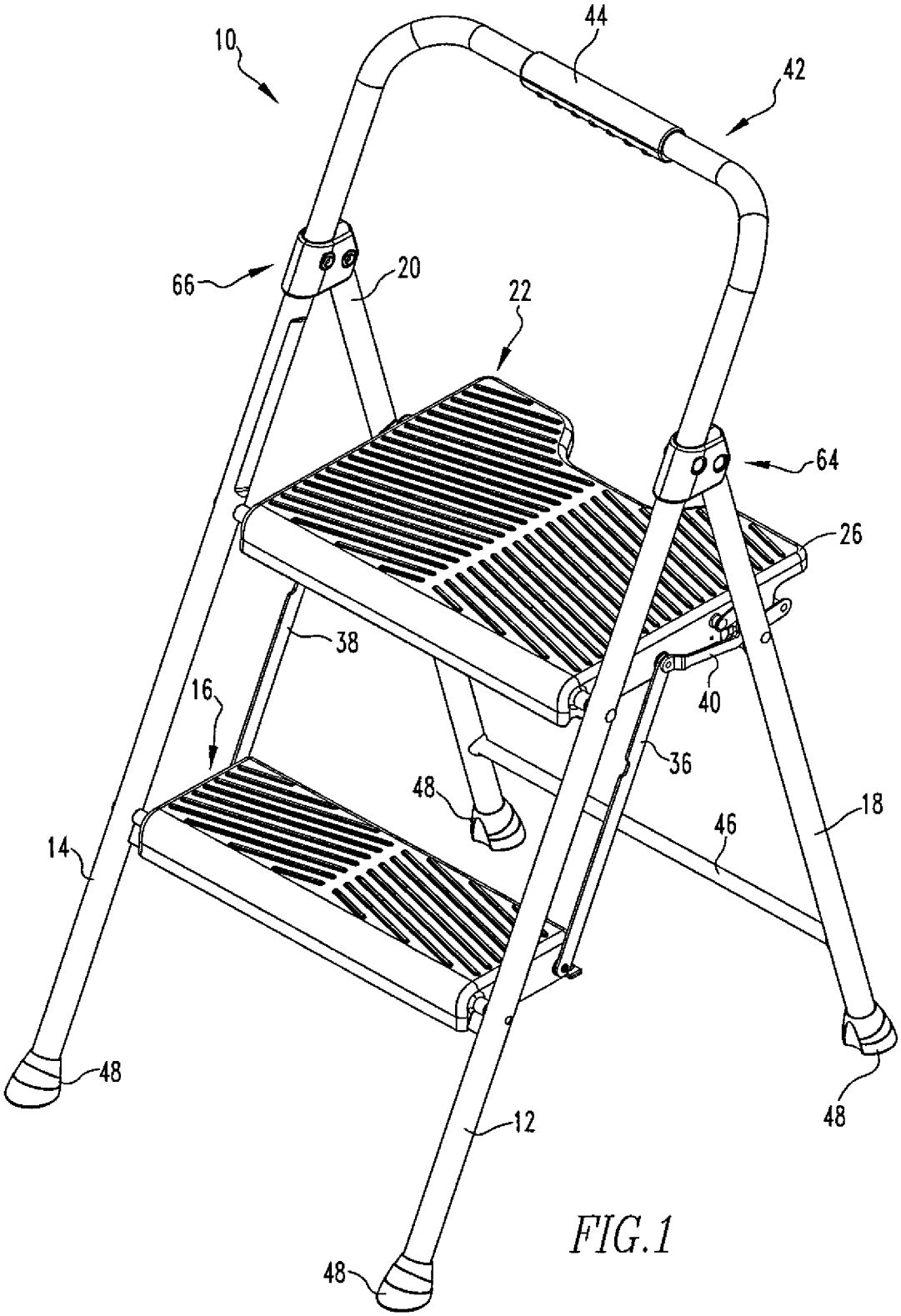
FIG. 1 is a perspective view of a stepstool of the present invention.

Referring now to the drawings wherein like reference numerals refer to similar or identical parts throughout the several views, and more specifically to FIGS. 1-9 thereof, there is shown a step stool 10. The step stool 10 comprises a first front leg 12. The step stool 10 comprises a second front leg 14 in parallel and spaced relation with the first front leg 12. The step stool 10 comprises a first step 16 having a length rotatably attached to the first front leg 12 and the second front leg 14, a top 24 and a perimeter 26 about the top 24. The perimeter 26 having a first side 28 which extends down from the top 24. The first step 16 having a first boss 30 that extends outward from the first side 28 through which a first fastener 32 extends to attach the first front leg 12 to the first step 16. The first step 16 having a rib 34 which extends outwards from the first side 28 adjacent the first boss 30 and in alignment with the first front leg 12 when the first and second front legs 12, 14 and first and second rear legs 18, 20 are in an open position where they form a generally upside down V shape. The rib 34 providing support to the first front leg 12 when a cantilever type force is applied to the stepladder. The step stool 10 comprises a first rear leg 18 hingedly attached to the first front leg. The step stool 10 comprises a second rear leg 20 hingedly attached to the second front leg 14 and in spaced relation with the first rear leg 18. The step stool 10 comprises a platform 22 having a length at least 1.5 times the length of the first step 16. The platform 22 is rotatably attached to the first front leg 12 and the second front leg 14 above the first step 16.

The rib 34 may contact the first front leg 12 when the first front leg 12 is in the open position. The rib 34 may extend at an angle across the first side 28 which corresponds to an angle that the first front leg 12 forms with the first side 28. The rib 34 may extend from the boss.

The step stool 10 may include a first link 36 which attaches to the first side 28 of the first step 16 and the platform 22 and a second link 38 which attaches to the platform 22 and the first step 16. The first step 16 may hang from the platform 22 by the first and second links 36, 38.

The stepladder may include a third link 40 which extends from the platform 22 to the first rear leg 18. The third link 40 and the first link 36 are attached to the platform 22 at a same location.

The single rib 34 that extends down from the boss and out from the perimeter 26 of either front side of the first step 16, strengthens the corresponding leg from a cantilever load. The cantilever load is essentially a load on the front legs similar to someone grabbing the bottom of the front legs and trying to squeeze them together.

The single rib 34, which extends down from the boss and out from the perimeter 26 is positioned to align linearly with the front leg the rib 34 is supporting when the step stool 10 is in an open use position. By the single rib 34 extending out from the perimeter 26 and down from the boss along the inside of the leg which it is supporting, the rib 34 provides a greater surface area through which any force or load on the leg is distributed to the first step 16. In addition, the single rib 34 by extending down from the boss effectively moves the bending or hinge point of the leg down, thus shortening the part of the leg that would otherwise bend, which effectively makes the leg stronger. This effectively shortens the bending moment regarding the leg. In this way, the platform 22 through the single rib 34 effectively supports the leg against such a cantilever load.

As shown in FIG. 1, the first front leg 12 and the second front leg 14 may be one continuous piece that forms a U shape with the top 42 of the U shape disposed above the platform 22. The top 42 of the U shape may serve as a handle to a user standing on the platform 22. At the middle of the top 42 of the U shape may be a grip 44 to further facilitate a user standing on the platform 22 better holding onto the top 42 of the U shape as a handle. A first hinge 64 rotatably attaches the first front and rear legs together, and a second hinge 66 rotatably attaches the second front and rear legs together.

Connected to the first rear leg 18 and the second rear leg 20 may be a crossbar 46 to provide additional stability to the stepstool tent when in the open position. At the bottom of each leg may be attached a molded rubber foot 48 that has a hole in it to receive the bottom of each leg. The rubber feet 48 serve to add more friction and thus more resistance to the stepstool moving, and thus more stability, when the stepstool 10 is in the open position. A strut 60 attaches to the first and second rear legs. The rear of the platform 22 rests against the strut 60, and is supported by the strut 60 when the step stool 10 is in the open position.

Figure 3:
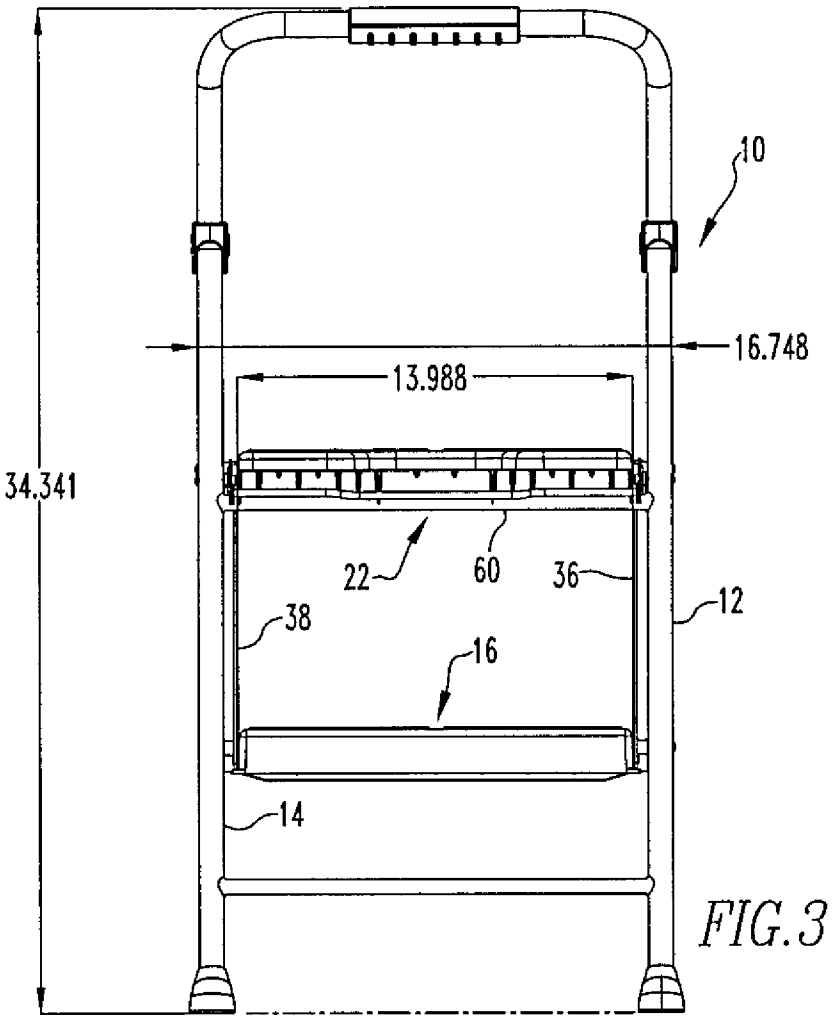
FIG. 3 is a front view of the stepstool.
Figure 2:
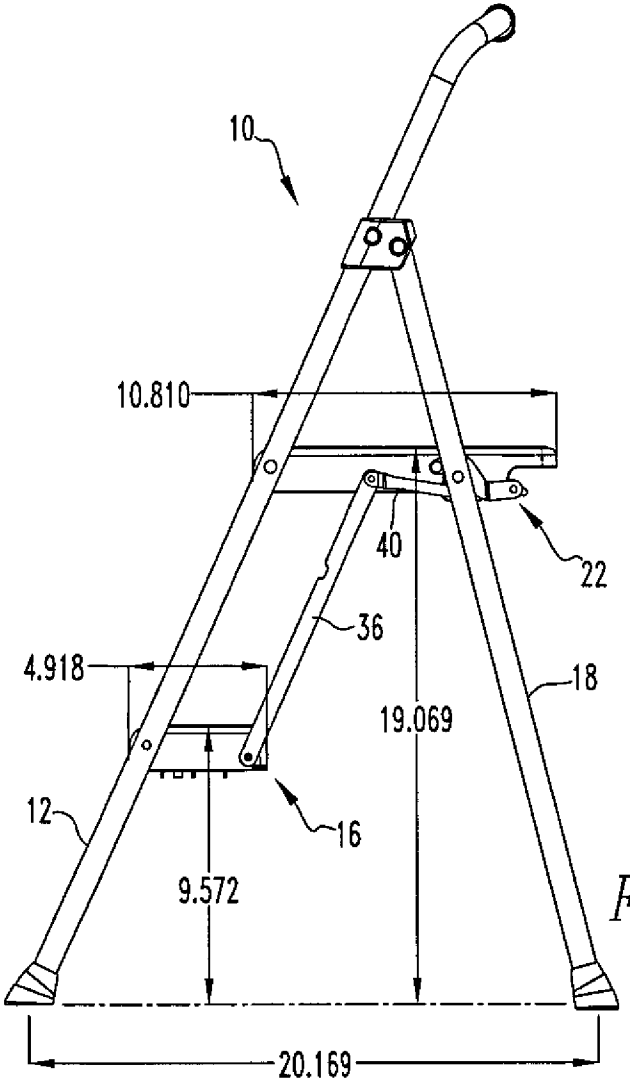
FIG. 2 is a side view of the stepstool.
Figure 5:
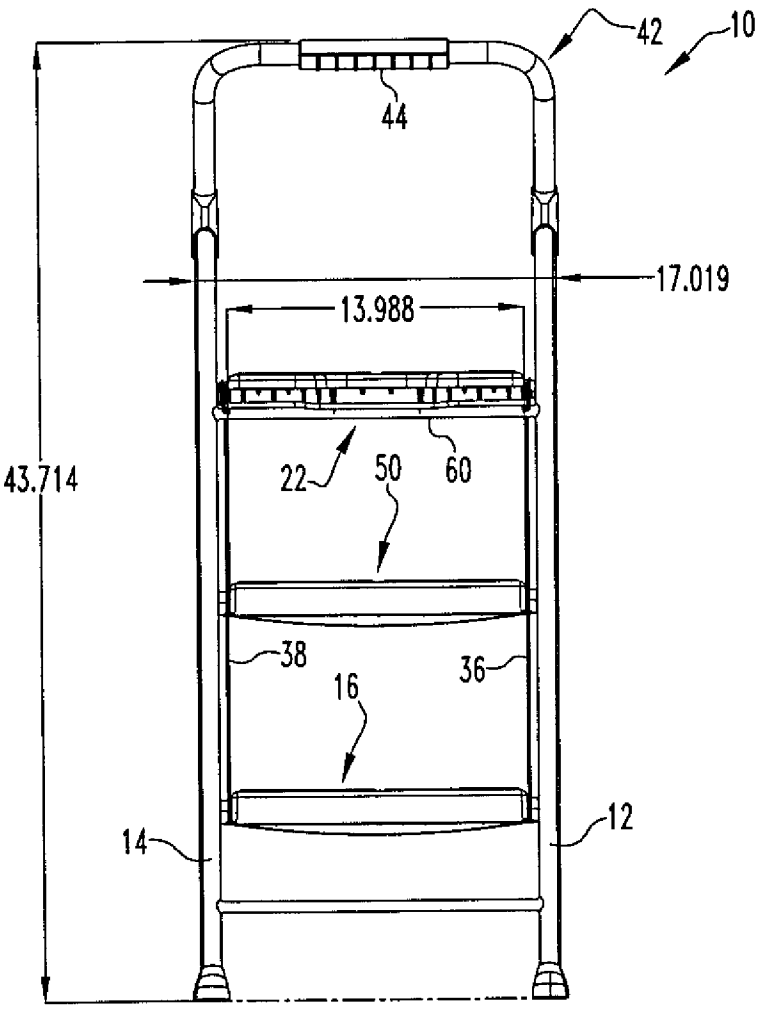
FIG. 5 is a front view of the second embodiment of the stepstool.
Figure 4:
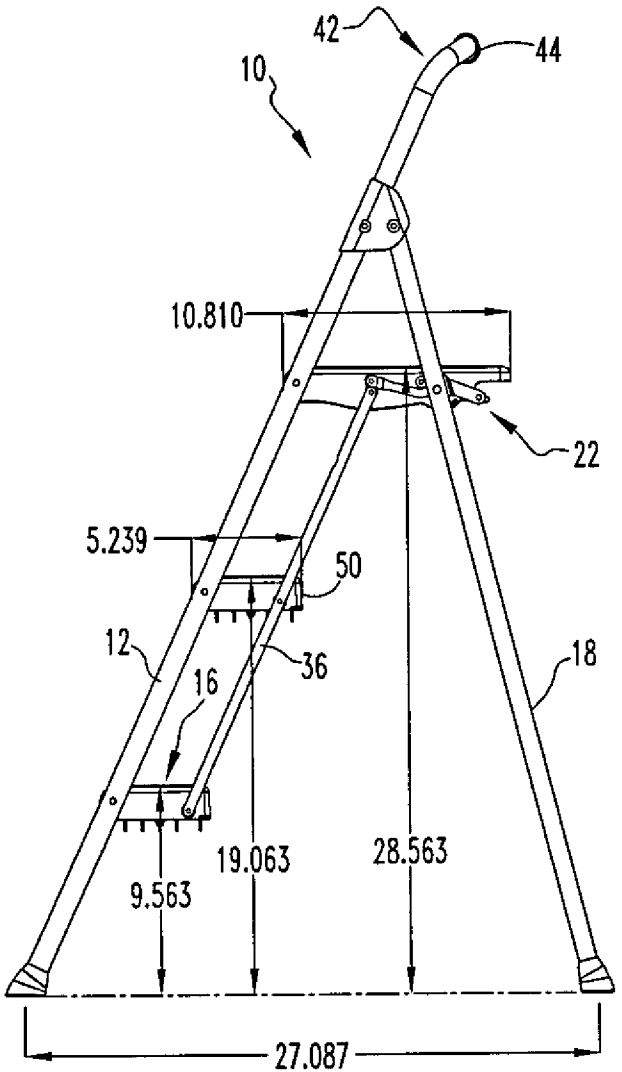
FIG. 4 is a side view of a second embodiment of the stepstool with a second step.

As shown in FIGS. 4 and 5, the stepstool 10, in a second embodiment, may have a second step 50 disposed between the first step 16 in the platform 22, to allow the stepstool 10 to be larger and for the platform to be positioned higher off the ground and in the first embodiment shown in FIGS. 3 and 4. In the second embodiment, the first link 36 extends from the platform 22 down to the first step 16 and also attaches to the first side 28 of the second step 50. The second step 50 is also rotatably fixed to the first and second front legs so when the stepstool 10 is moved into the folded position, the second step 50 also moves up, like the first step 16 as the first link 36 moves into the folded position, guiding the first and second steps to which it is attached to the closed position. In all other ways, the second embodiment is configured and operates like the first embodiment.

The first step 16 is rectangular in shape. There is the first side 28, and an opposing second side 54 parallel and spaced relation with the first side 28, a front side 56 that extends perpendicularly from and between the first side 28 and the second side 54, and a rear side 58 that extends perpendicularly from and between the first side 28 and the second side 54 and in parallel and spaced relation with the front side 56. The first, second, front and rear sides extend down from the perimeter 26.

Figure 7:
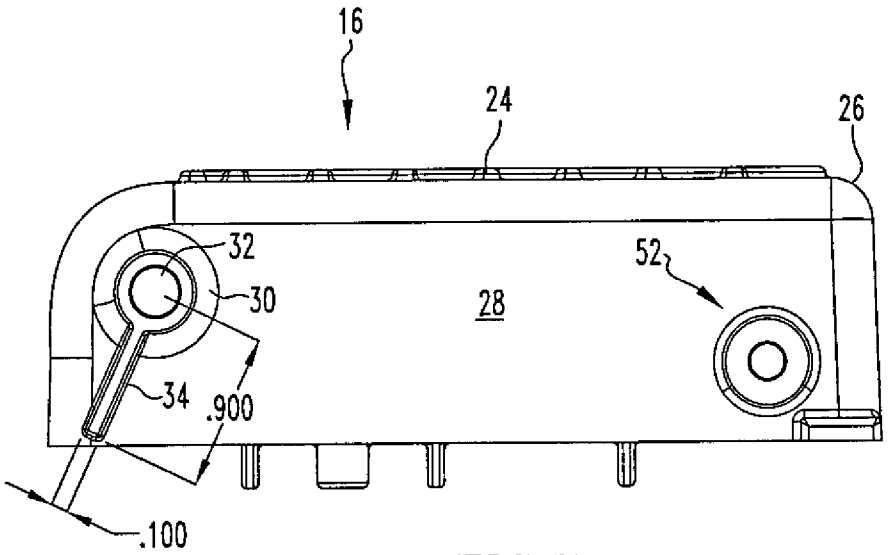
FIG. 7 is a side view of the platform.
Figure 6:
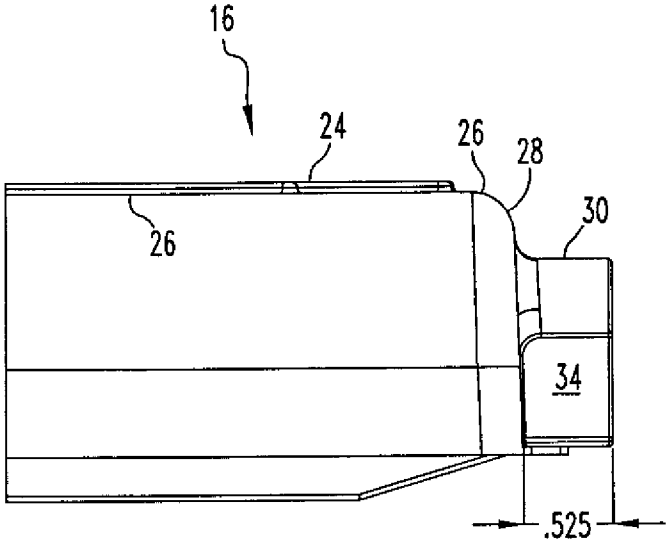
FIG. 6 is a front view of a portion of the platform.
Figure 8:
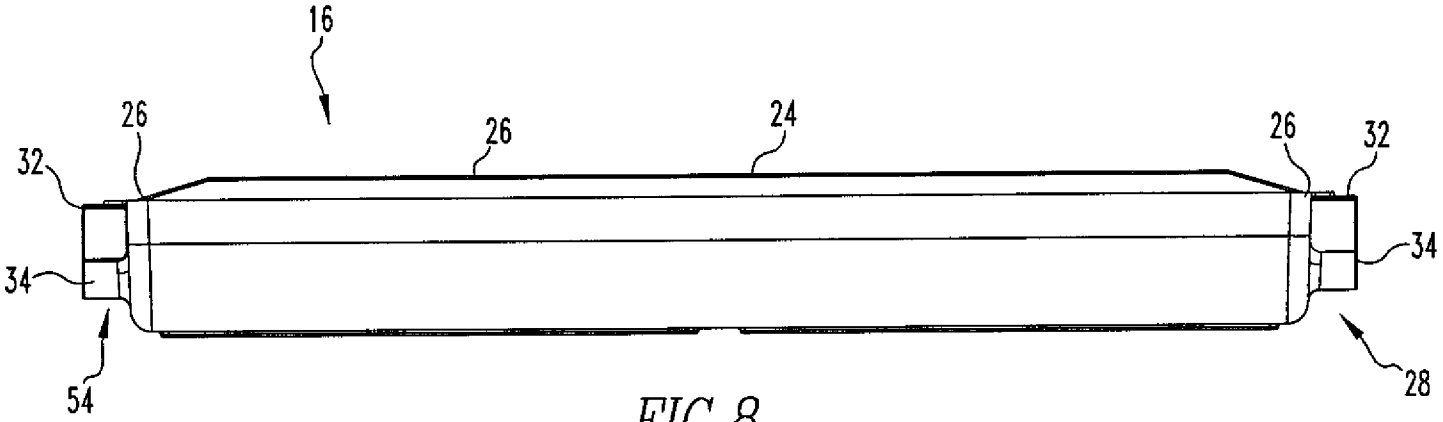
FIG. 8 is a front view of the platform.
Figure 9:
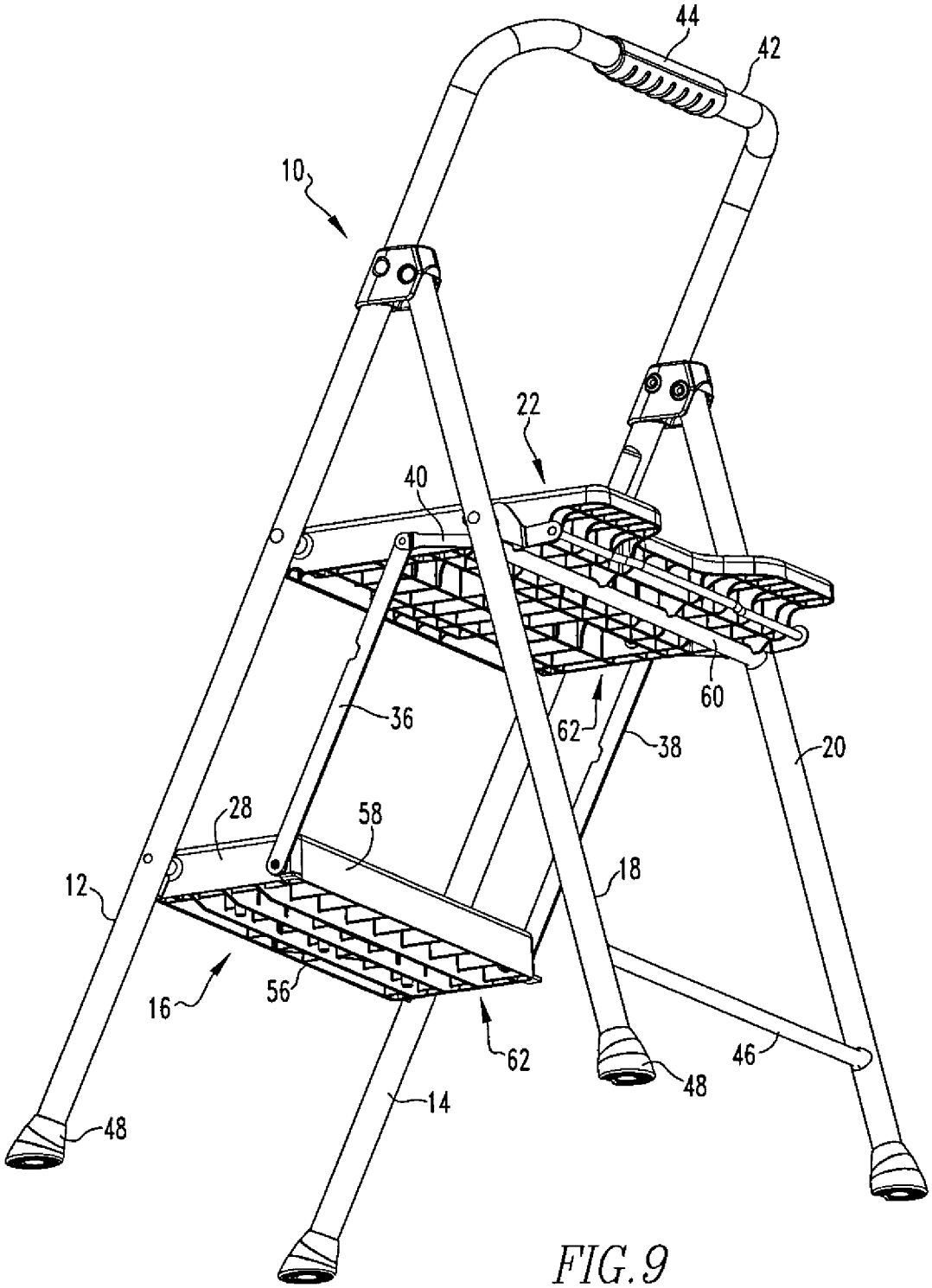
FIG. 9 is an underneath perspective view of the step stool in an open position.

As shown in FIG. 7, on the first side 28, there may be a second boss 52 which receives a fastener that extends through the bottom of the first link 36. The top of the first link 36 and the front of the third link 42 rotatably fix or attach to the platform 22. It should be noted that the configuration and operation of a second side 54 of the first step 16 and the platform 22 is identical to the first side 28 of the first step 16 and the platform 22. The bottom of the first step 16 and the platform may be formed with buttressing 62, for instance in a cross-hatching pattern which form a plurality of boxes The present invention pertains to a method for using a step stool 10. The method comprises the steps of placing the step stool 10 in a position so a user can climb on the step stool 10. There is the step of applying a cantilever load to the step stool 10 while in the open position causing a first right leg to press against a rib 34 which extends outwardly from a first side 28 of a first step 16 adjacent a first boss 30 of the first side 28 and in alignment with a first front leg 12 of the step stool 10 when the first and second front legs 12, 14 and first and second rear legs 18, 20 of the step stool 10 are in an open position where they form a generally upside down V shape.

Examples of similar existing step stools to which the described rib 34 herein can be added are Werner step stool model S323PR and S322PR. The legs can be steel or aluminum tubes. The step stool 10 is able to support at least 250 lbs. of load. In a standard molding process, the rib 14 is formed with the first step 16 of the same plastic material so the rib 14 and first step 16 and first boss are all formed at the same time as one continuous single piece.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A step stool comprising:

a first front leg;

a second front leg in parallel and spaced relation with the first front leg;

a first rear leg hingedly attached to the first front leg;

a second rear leg hingedly attached to the second front leg and in spaced relation with the first rear leg;

a first step having a length rotatably attached to the first front leg and the second front leg, a top and a perimeter about the top, the perimeter having a first side which extends down from the top, the first step having a first boss that extends outward from the first side through which a first fastener extends to attach the first front leg to the first step, the first step having a rib which extends outwards from the first side adjacent the first boss and in alignment with the first front leg when the first and second front legs and first and second rear legs are in an open position where they form a generally upside down V shape, the first step and the first boss and the first rib being one continuous piece of plastic, the first boss and the rib disposed between the first step and an inside of the first front leg, the rib which extends down from the boss and out from the perimeter is positioned to align linearly with the first front leg that the rib is supporting when the step stool is in an open use position, by the rib extending out from the perimeter and down from the boss along the inside of the first front leg which the rib is supporting, the rib provides a greater surface area through which any force or load on the first front leg is distributed to the first step, and in addition, the rib by extending down from the boss effectively moves a bending or hinge point of the first front leg down, thus shortening that part of the first front leg that would otherwise bend, which effectively makes the first front leg stronger; and a platform having a length at least 1.5 times the length of the first step, the platform rotatably attached to the first front leg and the second front leg above the first step.

2. The step stool of claim 1 wherein the rib contacts the first front leg when the first front leg is in the open position.

3. The step stool of claim 2 wherein the rib extends at an angle across the first side corresponding to an angle that the first front leg forms with the first side when in the open position.

4. The step stool of claim 3 including a first link which attaches to the first side of the platform and the step and a second link which attaches to the platform and the step.

5. The step stool of claim 4 including a third link which extends from the first side of the platform to the first rear leg, the third link and the first link attached to the platform at a same location.

* * * * *